United States Patent [19]

Kley

[11] 4,114,134

[45] Sep. 12, 1978

[54] POTENTIOMETER

[76] Inventor: Victor B. Kley, 2211 Byron St., Berkeley, Calif. 94702

[21] Appl. No.: 719,407

[22] Filed: Sep. 1, 1976

[51] Int. Cl.[2] ..... H01C 1/02

[52] U.S. Cl. ..... 338/231; 338/114; 338/184; 338/196; 338/202; 338/227

[58] Field of Search ..... 338/68, 231, 114, 55, 338/202, 184, 199, 164, 166, 119, 227, 99, 210

[56] References Cited

U.S. PATENT DOCUMENTS 3,918,020 10/1974 DuRocher ..... 338/114

*Primary Examiner*—C. L. Albritton

*Attorney, Agent, or Firm*—O'Brien and Marks

[57] ABSTRACT

A potentiometer includes a conductive member and a resistive member both enclosed in a flexible fluid-filled bag so that depression of a point on the bag causes the conductive member to touch a point on the resistive member. Latching means are provided to latch the bag in its depressed position at any point and two forms of visual indication are provided for displaying the resistance values selected.

13 Claims, 4 Drawing Figures

FIG. 2
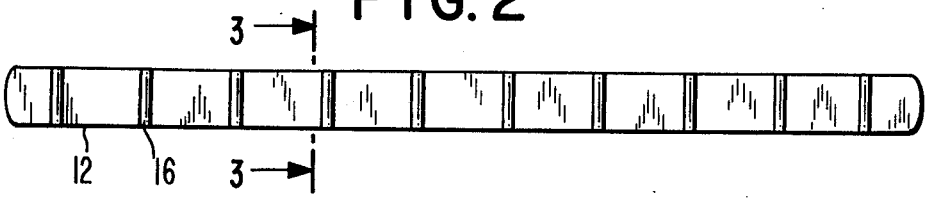
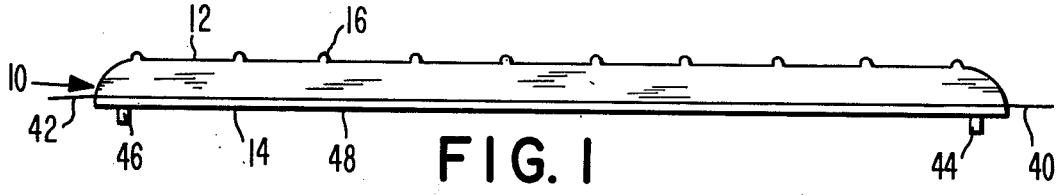
FIG. 1
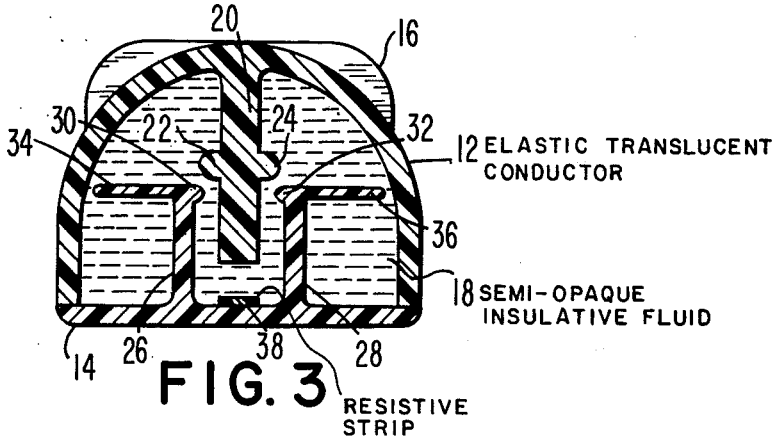
FIG. 3
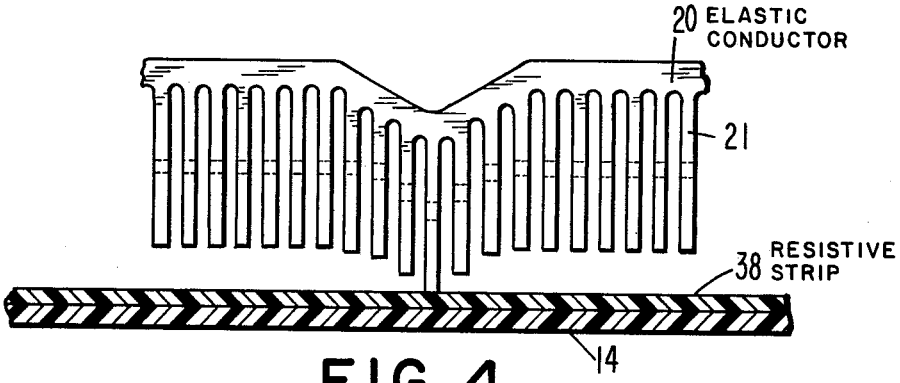
FIG. 4

POTENTIOMETER

BACKGROUND OF THE INVENTION

1. Field of the Invention

The invention relates to potentiometers in general, and in particular for continuous potentiometers capable of easy use by unsophisticated users in control applications.

2. Description of the Prior Art

It has long been known in the art to construct potentiometers by providing a conductive strip and a resistive strip which may be brought together at different points for different resistance values. It has been a problem in the art to construct such devices with simple and effective de-latching mechanisms for unselected points and for simple visual indications of selected resistance values.

SUMMARY OF THE INVENTION

This invention is summarized in that a potentiometer includes a base member, a flexible top cover attached to the base member so as to form a closed receptacle therebetween, an insulating fluid filling the receptacle, a resistive member attached to one of the base members and the top cover, and a conductive member attached to the other of the base member and top cover, so that the conductive member and the resistive member touch when the top cover is depressed.

An object of the present invention is to construct a potentiometer that latches at a selected resistive value and automatically delatches all other resistance values with a minimum of mechanical coupling.

It is another object of the present invention to provide such a potentiometer which is simple, easy to construct, economical and durable.

It is yet another object of the present invention to construct such a potentiometer which includes appropriate visual indication of the point of the resistance value selected.

Other objects, advantages and features of the present invention will become apparent from the following specification when taken in conjunction with the accompanying drawings.

BRIEF DESCRIPTION OF THE DRAWINGS

FIG. 1 is a side elevation view of a potentiometer constructed according to the present invention.

FIG. 2 is a top plan view of the potentiometer of FIG. 1.

FIG. 3 is a cross-section along the line 3—3 of FIG. 2.

FIG. 4 is a close-up side view of several elements in the interior of the potentiometer of FIG. 1.

DESCRIPTION OF THE PREFERRED EMBODIMENT

Shown in FIG. 1, is a potentiometer, generally indicated at 10, constructed according to the present invention. The potentiometer 10 is of an elongated, generally linear shape defined mainly by a top cover member 12 which extends the length of the potentiometer 10 and is formed of an elastic, translucent, resilient material. The material of the top cover 12 is preferably formed of an electrically conductive material and the top cover 12 is formed so as to have a generally semi-circular cross-section. The open end of the semi-circle of the top cover 12 is closed by an elongated rigid base member 14 attached to both sides of the top cover 12. A plurality of ribs 16 are formed on the outer surface of the top cover 12, the ribs 16 being distributed at equal distances from each other along the length of the potentiometer 10. The top cover 12 and the base member 14 form therebetween a semi-circular enclosed receptacle or bag. The bag there formed is filled completely with an insulating fluid 18. The insulating fluid 18 is preferably a liquid of an insulating and semi-opaque or translucent nature. An elongated comb-like member 20 is formed integrally with the top cover 12 and extends downward from the center of the inside of the top cover 12 and the base member 14. The comb-like member 20 extends the full length of the top cover 12 and, being integrally formed with the top cover 12, is formed also of an electrically conductive material. The comb-like member 20 includes, as can be seen in FIG. 4 a multiplicity of depending electrically conductive fingers 21. A pair of latching bumps 22 and 24 are formed on opposite sides of each of the fingers 21 and are located on the fingers 40 at a point halfway between the top cover 12 and the base member 14.

Formed on the base member 14 and also extending the length of the potentiometer 10 is a pair of upstanding contrast plate supports 26 and 28, which extend upward from the base member 14 on opposite sides of the central longitudinal axis thereof. A pair of contrast plates 34 and 36 extend outward from the respective top of each of the contrast plate supports 26 and 28 in a horizontal direction generally parallel to the base member 14. The contrast plates 34 and 36, which also extend almost the entire length of the potentiometer 10, are formed of a material of a highly colored or reflective nature. Respective locking ribs 30 and 32 are formed on the interior edges of each of the contrast plates supports 26 and 28 at the top edges thereof opposite from the contrast plates 34 and 36 respectively. An electrically resistive element in the form of a resistive strip 38 is provided extending along the center of the top surface of the base member 14, the resistive strip 38 being formed of a material having a constant resistance value per unit length. Suitable top cover terminal connections 40 and 42 are provided for electrical connection to the top cover 12. Similarly suitable resistive strip terminal connectors 44 and 46 extend through the base member 14 to make electrical contact with the resistive strip 38. Suitable external electronic circuitry (not shown) of a conventional resistance measuring or control nature is attached to the terminal connections 40, 42, 44 and 46. The base member 14 may optionally be provided with an adhesive layer 48 of pressure or heat sensitive adhesive applied to its back surface.

In the operation of the potentiometer 10 of FIGS. 1 to 4, a user of the potentiometer depresses a point on the exterior of the top cover 12 to select a particular resistance value. The user manually depresses the exterior of the top cover 12 causing the top cover 12 to flex thereby bending the comb-like member 20 also, as is shown in FIG. 4. When such a bend is created in the comb-like member 20, one of the fingers 21 is downwardly moved until it touches the resistive strip 38, as can be clearly seen in FIG. 4. When such a one of the fingers 21 is moved downwardly, the locking bumps 22 and 24 on that finger 21 pass between the locking ribs 30 and 32 provided on the contrast plate support members 26 and 28. This latches the top cover 12 in a depressed or flexed position at the point selected as the locking ribs 30 and 32 latch over the latching bumps 22 and 24.

The exterior electronic circuitry attached to the terminal connections 40, 42, 44 and 46 is then able to measure or be controlled by the resistance between each of the ends of the top cover 12 and the point which has been depressed and at which the one of the fingers 40 is touching the resistive strip 38. The value of the resistance thus measured will be directly proportional to the distance from each of the ends of the potentiometer 10 at which the top cover 12 was touched. The ribs 16 formed on the exterior of the top cover 12 provided a visual scaled indication of the approximate value of the resistance that can be selected at each point. Inasmuch as it may not be otherwise readily apparent at all times exactly which point on the top cover 12 has been selected, an additional optical visualization of that depression is provided by the contrast plates 32 and 34. The semi-opaque or translucent character of the fluid 18 causes the contrast plates 34 and 36, which are either of a reflective or of a brightly colored nature relative to the top cover 12, to be visible only where the top cover 12 has been displaced. At that point, the top cover 12 will have been bought closer to the contrast plates 34 and 36 thereby reducing the amount of the fluid 18 between the top cover 12 and the contrast plates 34 and 36. The translucency of the fluid 18 thereby allows the contrast plates 34 and 36 to show through from the interior of the potentiometer 10 to give a visual indication only at that point where the top cover 12 has been displaced. Depression of the top cover 12 at a second point different from that at which it was originally depressed will again cause a one of the fingers 21 at the new depression to move downwardly and latch. Simultaneously, inasmuch as the receptacle formed by the top cover 12 and the base member 14 is of a limited volume, the depression of the new point will cause the fluid within this receptacle to exert an upward pressure or force at the first point to snap the latching bumps 22 and 24 through the ribs 30 and 32 at that point to delatch the top cover 12 in that area. Thus only one point at a time along the length of the potentiometer 10 can be selected, and the potentiometer clears itself when a new point is selected. The adhesive layer 48 on the back surface on the backing member 14 allows the potentiometer 10 to be attached to any suitable surface easily and quickly with no additional mechanical coupling being necessary.

It should be recognized that while potentiometer 10 is shown in a straight linear fashion in FIGS. 1 and 2, the potentiometer need not be in this precise configuration. The potentiometer 10 could be wound in a spiral or in a curve with or without vertical twisting.

It is also envisioned that variations of the arrangements of the conductive member and the resistive member within the scope of the present invention are possible. As for example, the comb-like member 20 need not be an integral portion of the top cover 12. The top cover 12 could be constructed of any suitable insulating transparent material while the comb-like member 20 could be formed of a conducting material of either a transparent or opaque nature. In such an arrangement the comb-like member 20 would be attached to the inside of the top cover 12 by adhesive bonding or other securing means. In another alternative embodiment, the position of the resistive member and the conductive member may be reversed, with the resistive member taking a form similar to the comb-like member 20 and with the conductive member being disposed upon the base member 14 in the manner of the resistive strip 38. Or in yet another variation, the comb-like member 20 could be attached to the base member 14, and the resistive strip 38 attached to the top cover 12, as long as some latching means are provided to secure the top member 12 in its depressed position in the area which has been selected.

Thus according to the present invention, a potentiometer is provided which is extremely easy to use and which would provide a visual indication of the resistance selected. The potentiometer 10 can be manufactured so as to have any desired resolution and so as to provide either discrete or continuous resistance values by varying the number and placement of the fingers 21 extending from the comb-like member 20. Means are provided integrally within the potentiometer 10 to release the potentiometer at points other than that one currently selected with the need for no additional release mechanism. Two modes of visual confirmation of the point depressed are provided, with no external energy being consumed by either. In addition the potentiometer 10 is simple, easy to construct, rugged and economical.

Inasmuch as the present invention is subject to many variations, modifications and changes in detail, it is intended that all the material contained in the foregoing specification or in the accompanying drawings, be interpreted as illustrative, and not in the limiting sense.

What is claimed is:

1. A potentiometer comprising a base member, a flexible cover attached to the base member so as to form a closed receptacle therebetween, an insulating fluid filling the receptacle, a resistive member attached to one of the base member and the top cover, and a conductive member attached to the other of the base member and top cover, so that the conductive member and the resistive member touch when the top cover is depressed at a selected point determining the value of resistance thus connected to the conductive member, said fluid exerting a pressure on the cover when depressed such that contact between the resistive and conductive members at points spaced from the selected point is prevented.

2. A potentiometer comprising a base member, a flexible cover attached to the base member so as to form a closed receptacle therebetween, an insulating fluid filling the receptacle, a resistive member attached to one of the base member and the top cover, a conductive member attached to the other of the base member and top cover, so that the conductive member and the resistive member touch when the top cover is depressed, and latching means for latching the top cover at a depressed position at any point at which it is depressed.

3. A potentiometer as claimed in claim 1 wherein the conductive member is attached to the top cover.

4. A potentiometer comprising a base member, a flexible cover attached to the base member so as to form a closed receptacle therebetween, an insulating fluid filling the receptacle, a resistive member attached to one of the base member and the top cover, a conductive member attached to the other of the base member and top cover, so that the conductive member and the resistive member touch when the top cover is depressed, the conductive member being attached to the top cover, and the conductive member having a comb-like shape so as to form a plurality of depending fingers, at least one of the fingers touching the resistive member when the top cover is depressed.

5. A potentiometer as claimed in claim 4 wherein latching means are provided to latch onto and hold the fingers of the comb-like member which touch the resistive member.

6. A potentiometer as claimed in claim 5 wherein the latching means includes latching bumps on each side of each finger and latching ribs fixed to the base member, the latching ribs restraining the latching bumps on any finger that is depressed.

7. A potentiometer comprising a base member a flexible cover attached to the base member so as to form a closed receptacle therebetween, an insulating fluid filling the receptacle, a resistive member attached to one of the base member and the top cover, a conductive member attached to the other of the base member and top cover, so that the conductive member and the resistive member touch when the top cover is depressed, and a series of spaced ribs formed on the exterior of the top cover to provide a visual indication of the approximate resistance values at each point.

8. A potentiometer comprising a base member, a flexible cover attached to the base member so as to form a closed receptacle therebetween an insulating fluid filling the receptacle, a resistive member attached to one of the base member and the top cover, a conductive member attached to the other of the base member and top cover, so that the conductive member and the resistive member touch when the top cover is depressed, the fluid being semi-opaque, and at least one contrast plate being supported within the receptacle spaced from the base member so that the contrast plate is visible through the fluid in an area in which the top cover is depressed.

9. A potentiometer as claimed in claim 8 wherein there are two contrast plates extending the length of the potentiometer.

10. A potentiometer as claimed in claim 9 wherein contrast plate supports are provided to support the contrast plates and wherein latching ribs are provided on the contrast plate supports to latch down the top cover when it is depressed.

11. A potentiometer as claimed in claim 1 wherein an adhesive layer is applied to the back of the base member so that it may be easily mounted.

12. A potentiometer as claimed in claim 2 wherein the fluid exerts a pressure on the top cover when depressed such that contact between the resistive and conductive members at points spaced from the depressed point is prevented.

13. A potentiometer as claimed in claim 4 wherein the fluid exerts a pressure on the cover when depressed such that touching of fingers to the resistive member is prevented at points which are spaced from a selected point where the top cover is depressed.

* * * * *